US010415603B1

(12) United States Patent
Sommese

(10) Patent No.: US 10,415,603 B1
(45) Date of Patent: Sep. 17, 2019

(54) COMPRESSED AIR OPERATED FLUID PUMP APPLIED TO OIL WELLS

(71) Applicant: Gary J. Sommese, Fairfield, CA (US)

(72) Inventor: Gary J. Sommese, Fairfield, CA (US)

( * ) Notice: Subject to any disclaimer, the term of this patent is extended or adjusted under 35 U.S.C. 154(b) by 38 days.

(21) Appl. No.: 15/095,043

(22) Filed: Apr. 9, 2016

Related U.S. Application Data

(60) Provisional application No. 62/145,166, filed on Apr. 9, 2015.

(51) Int. Cl.

| | |
|---|---|
| ***F04F 1/12*** | (2006.01) |
| ***F04B 47/10*** | (2006.01) |
| ***F04F 1/08*** | (2006.01) |
| ***F04B 9/127*** | (2006.01) |
| ***F04F 1/18*** | (2006.01) |

(52) U.S. Cl.
CPC ..... *F04F 1/12* (2013.01); *F04B 9/1276* (2013.01); *F04B 47/10* (2013.01); *F04F 1/08* (2013.01); *F04F 1/18* (2013.01)

(58) Field of Classification Search
CPC ..... F04F 1/08; F04F 1/20; F04F 1/12; F04F 1/18; E21B 43/122–124; E21B 43/129; F04B 9/1276; F04B 47/10
See application file for complete search history.

(56) References Cited

U.S. PATENT DOCUMENTS 5,004,405 A * 4/1991 Breslin ..... F04B 47/08 417/126
2002/0182089 A1* 12/2002 Marvel ..... E21B 43/121 417/244

* cited by examiner

*Primary Examiner* — Kenneth J Hansen
(74) *Attorney, Agent, or Firm* — Pamela Winston Bertani

(57) ABSTRACT

The present invention is constructed for use with oil field pumps. The disclosed fluid pump is an apparatus that can replace conventional mechanical jack pumps, which are often problematic and inefficient during use. The present invention is a down hole fluid pump, which carries fluid upward by means of, a two phase flow of a compressed gas, and fluid. The fluid may be an admixture of petroleum oil and water. The compressed gas is generally air, but other gases may be applied. The inventive pump comprises multiple air lines, which allow serial connectivity with multiple oil wells. Multiple donut shaped magnets comprise the inventive fluid pump assembly, which facilitate effective and efficient fluid pump operation.

11 Claims, 7 Drawing Sheets

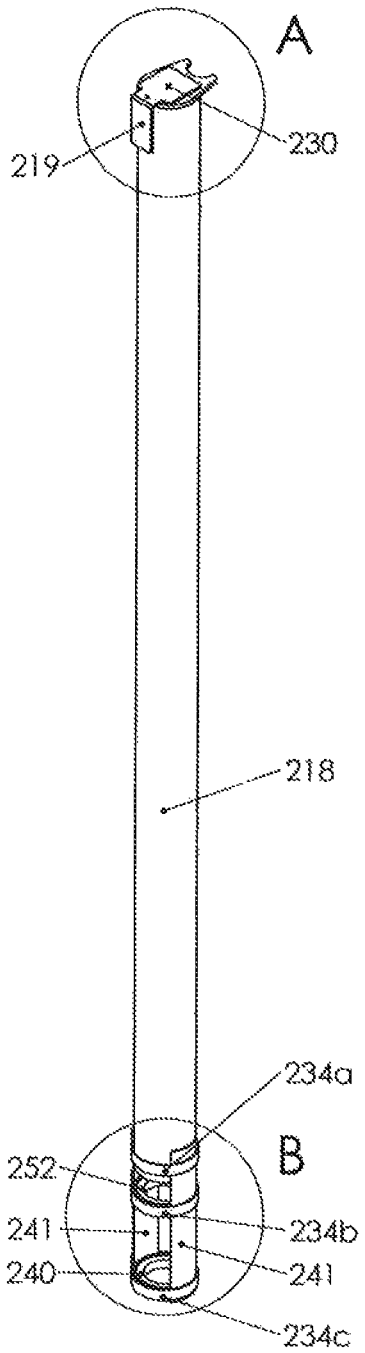
FIG. 16
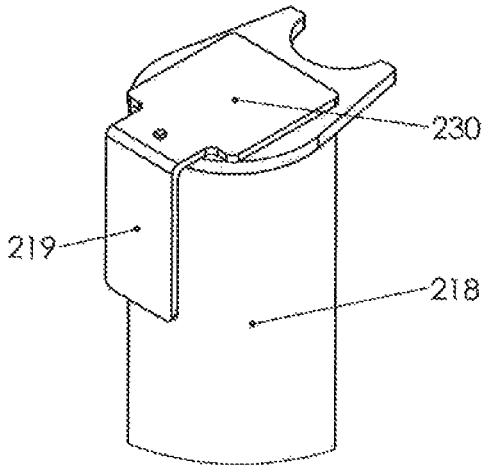
DETAIL A
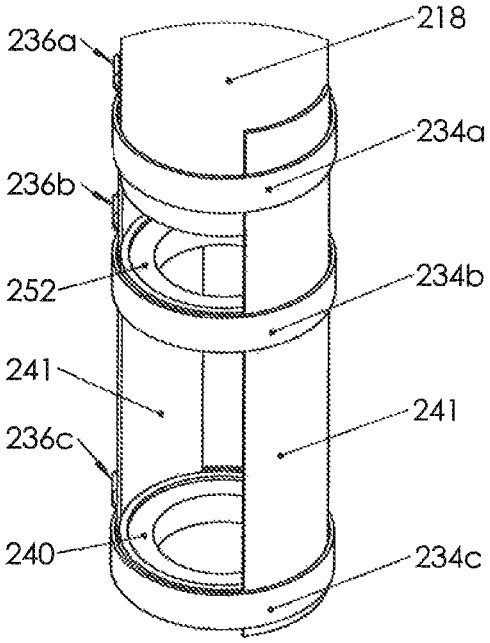
DETAIL B

COMPRESSED AIR OPERATED FLUID PUMP APPLIED TO OIL WELLS

BENEFIT CLAIM

Applicant claims the benefit of priority from previously filed provisional patent application No. 62/145,166 (confirmation number 7066), filed Apr. 9, 2015 for the invention entitled "Compressed Air Operated Fluid Pump Applied To Oil Wells".

FIELD OF INVENTION

The present invention relates generally to the field of petroleum oil field pumps. More specifically, the invention is an apparatus that can replace the problematic mechanical jack pump. The present invention is a down hole fluid pump, which carries fluid upward by means of a two phase flow of a compressed gas and the fluid. The fluid in practice can be an admixture of petroleum oil and water. The compressed gas is generally air. But other gas may be applied, depending on the application.

BACKGROUND

Although conventional compressed air lift fluid pumps exist, various aspects of the inventive down hole fluid pump are superior to conventional fluid pumps. For instance, the inventive fluid pump contains the necessary and sufficient components of a real world working compressed air down hole fluid pump, and several inventive actuating mechanisms to accomplish a seamless cyclic operation. In addition, the inventive down hole fluid pump has a cyclic operation that is highly reliable, and provides a long service life from a carefully selected complement of materials. The inventive fluid pump is designed and constructed to enable serial connectivity of multiple individual pump units to satisfy oil well depth requirements, and contains multiple port connections that operate to minimize human errors in field installation. The inventive down hole fluid pump also comprises the use of magnetic forces from multiple permanent donut shaped magnetic disks to provide actuating force trajectory that is nonlinear with translation, giving snappy valve control actuation. The inventive down hold fluid pump can provide lift action on the fluid of several admixture components, and can be used effectively for pumping deep water or stripper oil wells. In addition, the inventive down hole fluid pump has the ability to pump multi-component fluids, interconnect a plurality of pumps to meet different oil well depths, and has the compressed air (or gas) line being part of the inventive pump's internal structure, thus simplifying field installation.

SUMMARY

The present invention is directed to a compressed air down hole fluid pump that comprises various inventive actuating mechanisms to facilitate efficient and reliable cyclic operations, and consequently an extended service life of the inventive pump. The invention also incorporates a series of donut shaped magnets, that are strategically constructed and positioned to diminish the prospect of heavy metal accumulation from fluid within the pump, which facilitates efficient and reliable internal pump operation. In addition, the invention comprises a plurality of extra air lines running through the air pump, to facilitate providing air to pumps situated below the inventive air pump, and an air-out line that facilitates eliminating exhaust coming from pumps situated below the inventive pump. The extra air lines running through the inventive pump also connect to a foot valve, which facilitates holding the entire inventive fluid pump assembly together.

According to the present invention, compressed air is used to push down fluid within the air pump housing assembly, so that the fluid is forced to flow through the foot valve and internally disposed fluid channel, through a check valve, and ultimately to the surface. The purpose of incorporating the check valve is to ensure that once the compressed air is shut off, fluid exiting the pump through the check valve is not able to fall back into the pump.

The invention comprises a compressed air operated fluid pump for use in conjunction with oil wells comprising, in combination: a serial connectivity down hole fluid pump stainless steel housing; and a stainless steel serial connectivity down hole fluid pump internally disposed within the housing, wherein the fluid pump comprises a float unit to control air entering and exiting the pump, a plurality of magnets to facilitate positioning the float unit as air enters and exists the pump during operation of the pump in conjunction with oil wells; multiple air ports to facilitate air flow within the pump; multiple air lines to facilitate air flow within the pump; at least one fluid channel to facilitate moving fluid out of the pump; and a foot valve unit attached to the pump to control fluid entry into the pump and fluid exit from the pump.

The inventive fluid channel is vertically positioned in relation to the float, is parallel to the float, and extends above the float to facilitate pushing fluid out of the pump. The multiple air lines are vertically positioned in relation to the float, are parallel to the float, and extend above the float to connect to the multiple air ports, which facilitates the flow of air into the pump, and the exit of exhaust from the pump. The multiple air ports comprise a first air-in port, a second air-in port, and an air-out port to facilitate exhaust removal from the pump during use.

The inventive pump further comprises a linkage unit internally disposed within the pump and positioned above the float to control air flow into the pum and air flow out of the pump. The linkage unit further comprises an exhaust channel seal attached to a top plate of the linkage unit to control exhaust flow within the pump. The linkage unit is connected to an adjacent linkage unit guide plate and has a linkage unit hinge pin that facilitates moving the linkage unit up and down during pump operation.

The foot valve is positioned at the bottom of the pump and comprises a one-way check valve that allows fluid to flow into the pump, and prevents fluid from flowing out of the pump. The foot valve further comprises a bottom cap positioned at the bottom of the pump to facilitate retaining in place the multiple air lines in relation to the pump. The foot valve further comprises a rubber O-ring seal to facilitate forming a seal at the bottom of the pump. The foot valve further comprises an actuating flap to facilitate retaining fluid within the pump, and preventing fluid from exiting the pump.

The inventive magnets comprising the pump assembly comprise a stationary donut shaped magnet to facilitate moving the float upward and downward, and at least two moveable donut shaped magnets that facilitate movement of the float comprising the inventive fluid pump assembly.

BRIEF DESCRIPTION OF THE DRAWINGS

FIG. 16 is a front right view of the bottom section of the fluid pump without the stainless steel housing according to the present invention.

DETAILED DESCRIPTION

Figure 1:
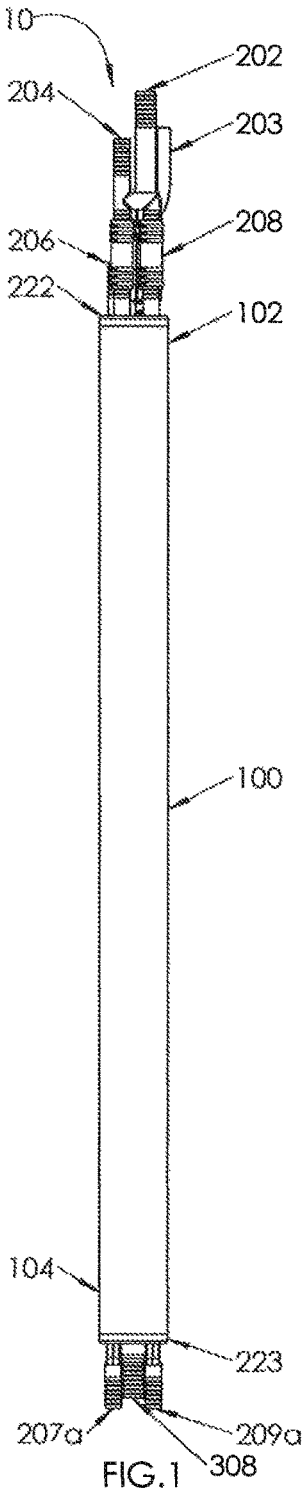
FIG. 1 is a front right view of the fluid pump assembly according the present invention.
Figure 2:
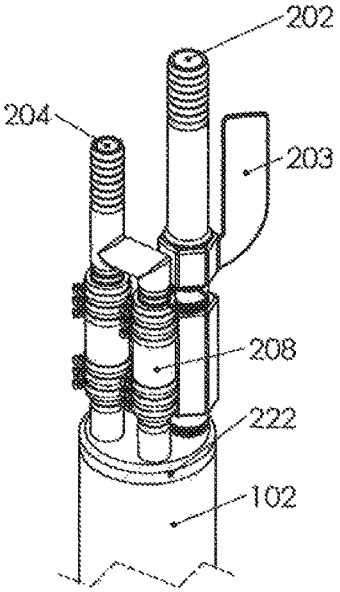
FIG. 2 is a top right view of the top section of the fluid pump assembly according to the present invention.
Figure 3:
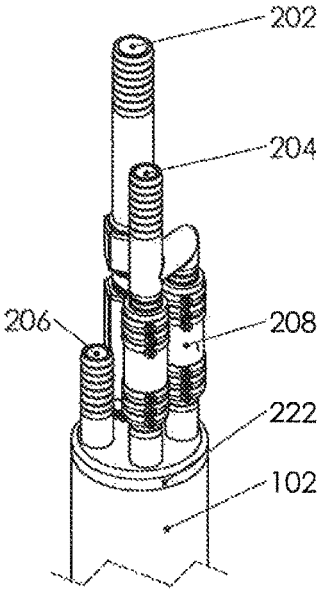
FIG. 3 is a top front view of the top section of the fluid pump assembly according to the present invention.
Figure 4:
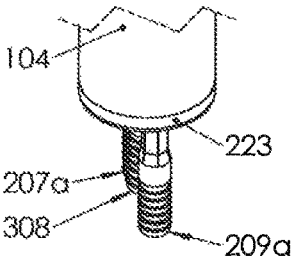
FIG. 4 is a top right view of the bottom section of the fluid pump assembly according to the present invention.
Figure 5:
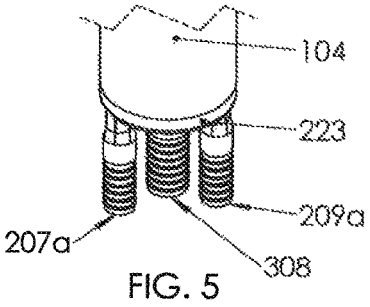
FIG. 5 is a top front view of the bottom section of the fluid pump assembly according to the present invention.
Figure 6:
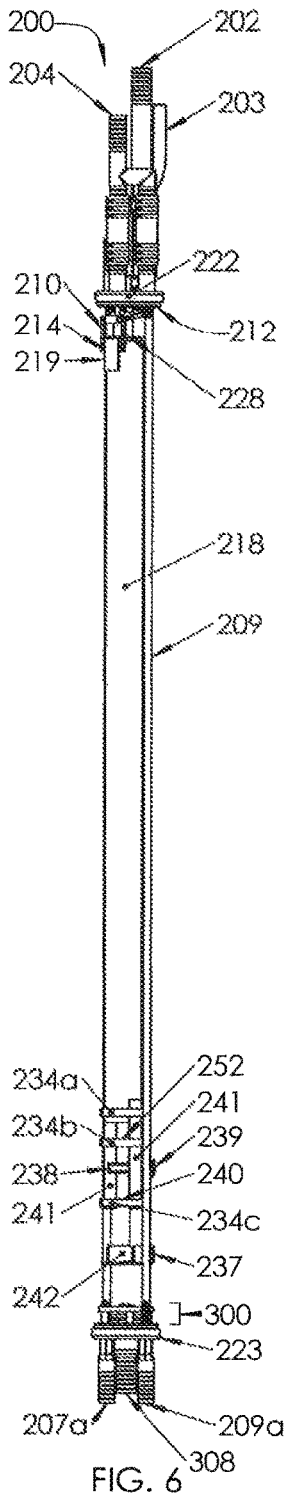
FIG. 6 is a front right view of the fluid pump without the stainless steel fluid pump housing according to the present invention.
Figure 7:
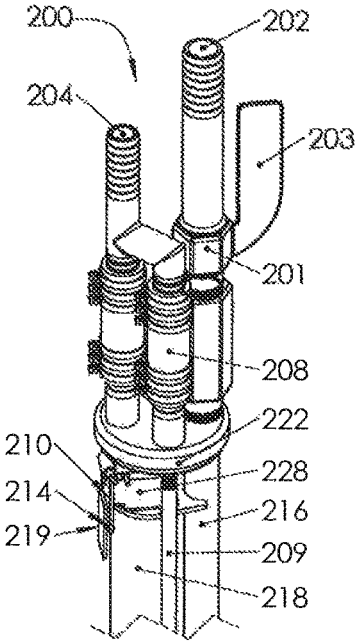
FIG. 7 is a top right view of top section of the fluid pump without the stainless steel fluid pump housing according to the present invention.
Figure 8:
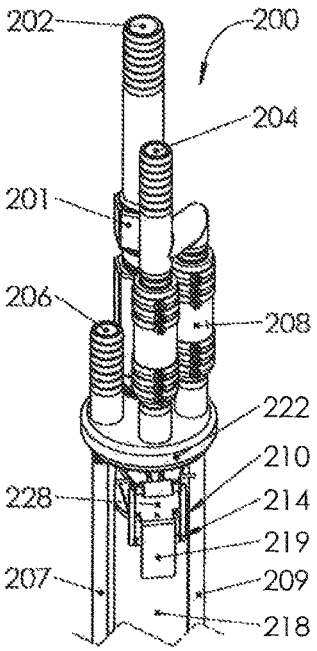
FIG. 8 is a top front view of the top section of the fluid pump without the stainless steel fluid pump housing according to the present invention.
Figure 9:
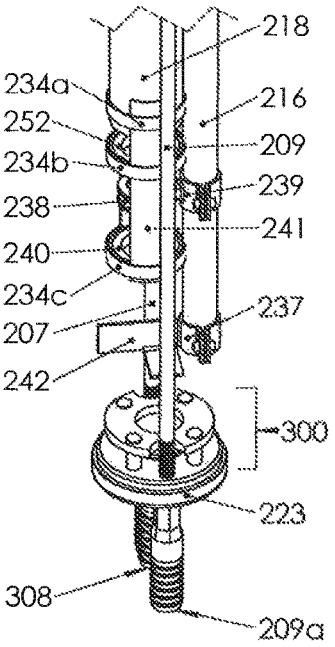
FIG. 9 is a top right view of the bottom section of the fluid pump without the stainless steel fluid pump housing according to the present invention.
Figure 10:
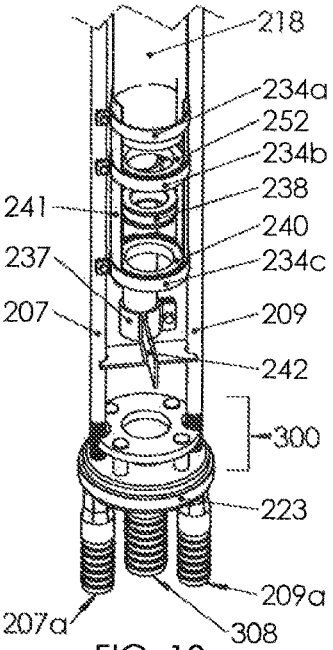
FIG. 10 is a top front view of the bottom section of the fluid pump without the stainless steel housing according to the present invention.
Figure 11:
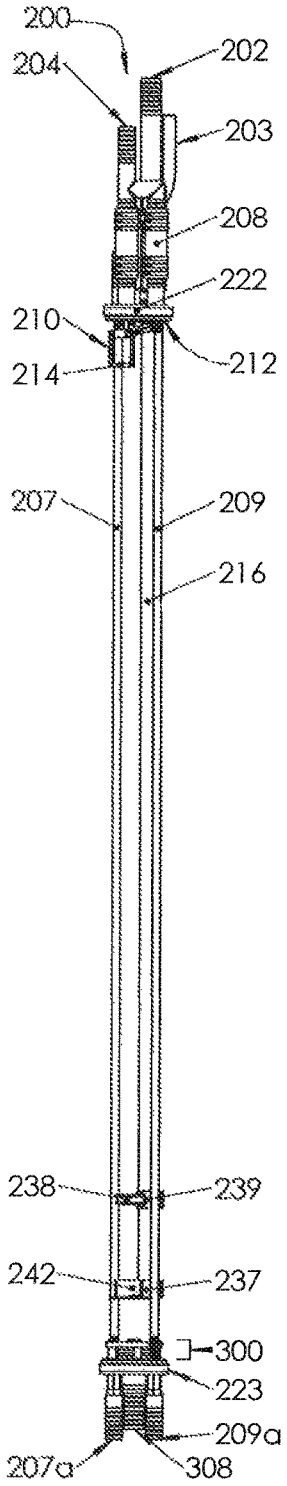
FIG. 11 is a front right view of the fluid pump without the stainless steel housing according to the present invention.
Figure 12:
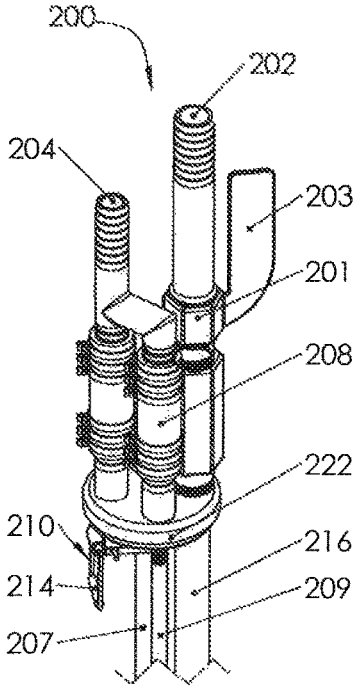
FIG. 12 is a top right view of the top section of the fluid pump without the stainless steel housing according to the present invention.
Figure 13:
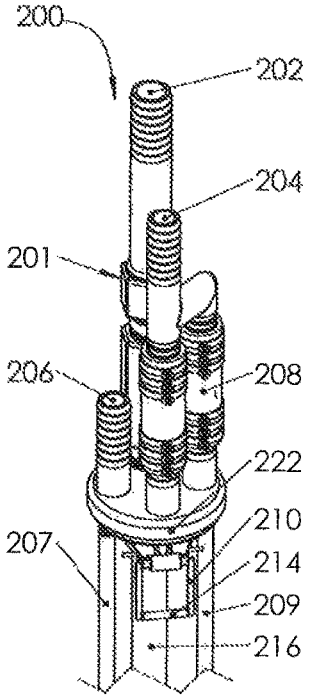
FIG. 13 is a top front view of the top section of the fluid pump without the stainless steel housing according to the present invention.
Figure 14:
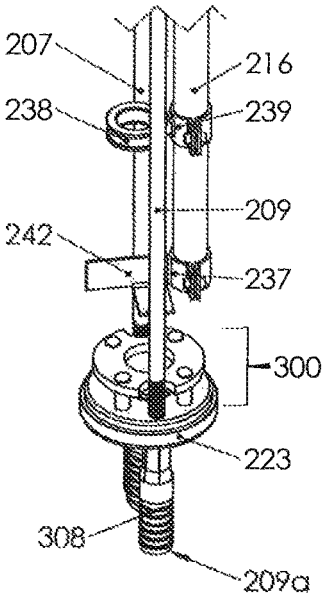
FIG. 14 is a top right view of the bottom section of the fluid pump without the stainless steel housing according to the present invention.
Figure 15:
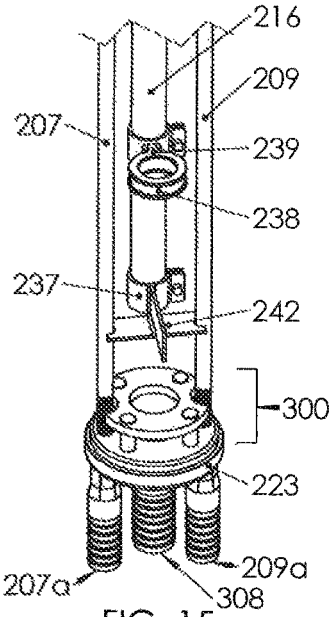
FIG. 15 is a top front view of the bottom section of the fluid pump without the stainless steel housing according to the present invention.

According to the present invention, compressed air operated fluid pump assembly (10) comprises stainless steel fluid pump housing (100), serial connectivity down hole fluid pump (200), and foot valve (300).

FIGS. 1-5 illustrate fluid pump assembly (10), with a portion of fluid pump (200) internally disposed within fluid pump housing (100), and therefore not depicted in FIGS. 1-5. Fluid pump housing (100) comprises a long cylinder, made of stainless steel. The outside diameter of fluid pump housing (100) is selected to fit the internally disposed fluid pump (200). There are two end cap disks, top end cap disk (222) and bottom end cap disk. (223). In use, top end cap disk (222) is at the top of fluid pump housing (100).

FIGS. 6-10 illustrate fluid pump (200), also comprising stainless steel, which is captured in place between top end cap disk (222) and bottom end cap disk (223) with two long rods, air-in line (209) and air-out line (207), which are threaded at both ends. Top end cap disk (222) has two blind taps to receive air-in line (209) and air-out line (207). Bottom end cap disk (223) has two through holes to allow the protrusion of the rod thread, each of which will receive a mounting hex nut, making the cylinder assembly tight and strong. In use, bottom end cap disk (223) is at the bottom of fluid pump assembly (10), immersed in the fluid that is to be pumped. The fluid enters inside of fluid pump housing (100), and internally disposed fluid pump (200), through fluid-in port (308) of foot valve (300). There is a mesh screen (not shown) within fluid-in port (308) to filter out unwanted solids.

FIGS. 11-15 illustrate various components comprising fluid pump (200). Positioned vertically and parallel to float (218) are three long tubes. The first of which is fluid channel (216). The lower end of fluid channel (216) is captured in place with lower guide support (242). Fluid channel (216) allows a fixed position mount for stationary donut magnet (238). On top of and below stationary donut magnet (238) are two moveable magnets, moveable donut magnet (252) and moveable donut magnet (240). All three magnets are disks of the same dimensions. The respective polarities of stationary donut magnet (238), moveable donut magnet (252) and moveable donut magnet (240) are oriented to attract moveable donut magnet (252) and moveable donut magnet (240) toward stationary donut magnet (238) when each of the moveable donut magnets come near stationary donut magnet (238) during operation of fluid pump assembly (10) according to the present invention.

Moveable donut magnet (252) and moveable donut magnet (240) are mounted differently to fluid pump (200) according to the present invention. More specifically in this regard, moveable donut magnet (252) terminates at the end of float (218). Stainless steel sheet metal shroud (234*a*) is positioned around the bottom end of float (218), and stainless steel sheet metal shroud (234*b*) is positioned around moveable donut magnet (252). Metal shroud (234*a*) and (234*b*) are arranged on opposite sides of float (218). Metal shroud (234*a*) and metal shroud (234*b*) are securely fastened with tube clamp (236*a*) and (236*b*). Metal shroud (234*c*) serves as the mount for moveable donut magnet (240).

As shown in FIGS. 11, 14, 15, 22 and 23, stationary donut magnet (238) is mounted to fluid channel (216) by tube clamp (239). Fluid channel (216) is fixed in position by end clamp (237). As shown in FIG. 16, moveable donut magnet (240) is integrated and stabilized within stainless steel metal shroud (234*c*), which is clamped to stainless steel mounting plate (241). Metal shroud (234*c*) makes moveable donut magnet (240) move as a single unit with moveable donut magnet (252), while stationary donut magnet (238) remains in place and attached to fluid channel (216).

Figure 20:
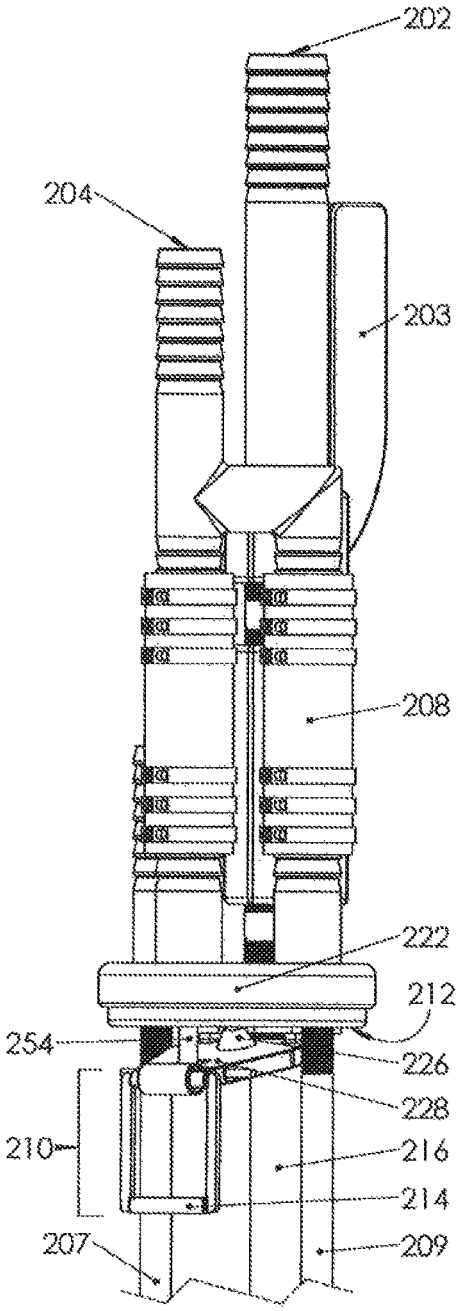
FIG. 20 is a front right view of the top section of the fluid pump without the stainless steel housing according to the present invention.
Figure 21:
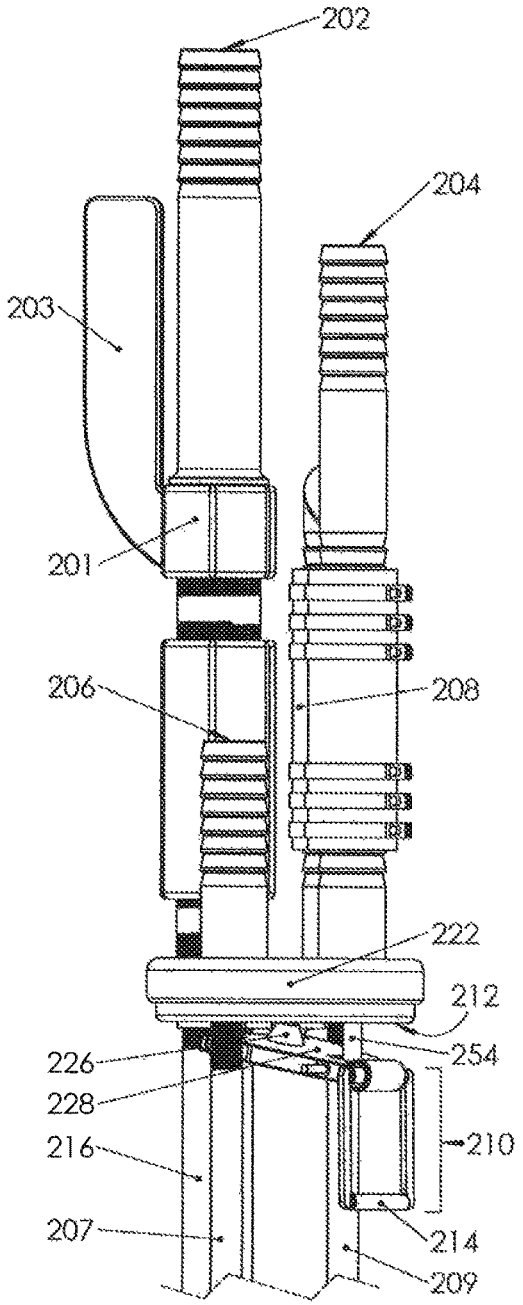
FIG. 21 is a front left view of the top section of the fluid pump without the stainless steel housing according to the present invention.
Figure 22:
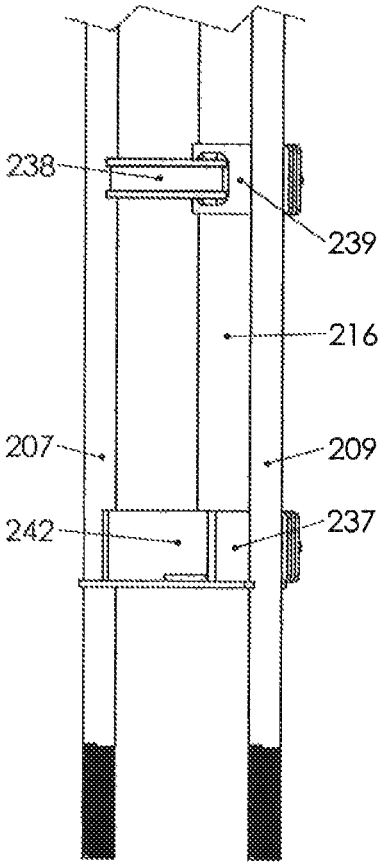
FIG. 22 is a front right view of the bottom section of the fluid pump without the stainless steel housing according to the present invention.
Figure 23:
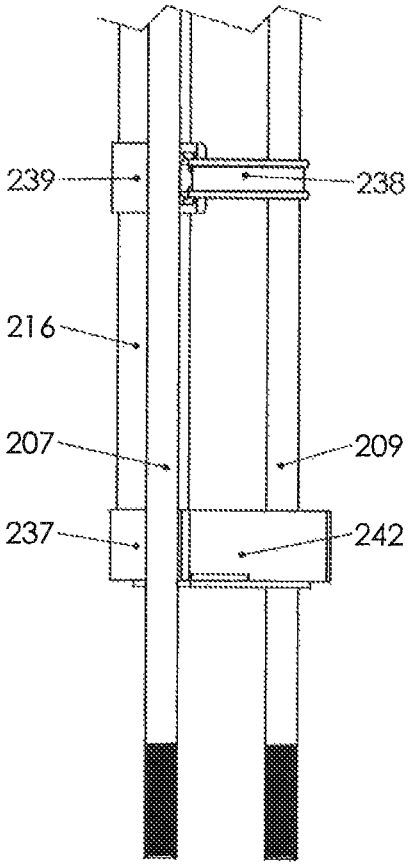
FIG. 23 is a front left view of the bottom section of the fluid pump without the stainless steel housing according to the present invention.

FIGS. 20 and 21 illustrate various aspects of the actuating components comprising inventive fluid pump (200). According to the present invention, stationary donut magnet (238), moveable donut magnet (240) and moveable donut magnet (252) are essential in achieving reliable and efficient operation of fluid pump assembly (10), and contribute to the long service life of fluid pump assembly (10). More specifically in this regard, the attractive forces between stationary donut magnet (238) and moveable donut magnet (240), as float (218) moves in an upward position, provides actuating valve assembly linkage unit (210), linkage unit guide plate (228), and upper linkage plate (230) (FIG. 16) the correct closure pressure during fluid pump (200) operation. The valve closure motion. created by linkage unit (210) begins with float (218) rising when fluid enters fluid pump (200), which is internally disposed within fluid pump housing (100).

Figure 18:
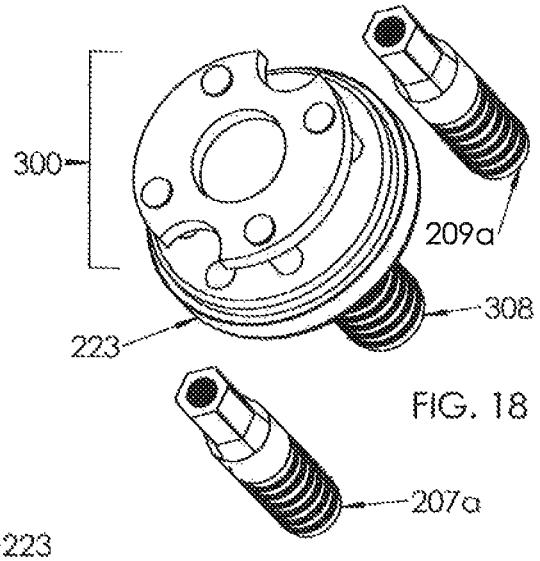
FIG. 18 is a top side view of the foot valve according to the present invention.
Figure 17:
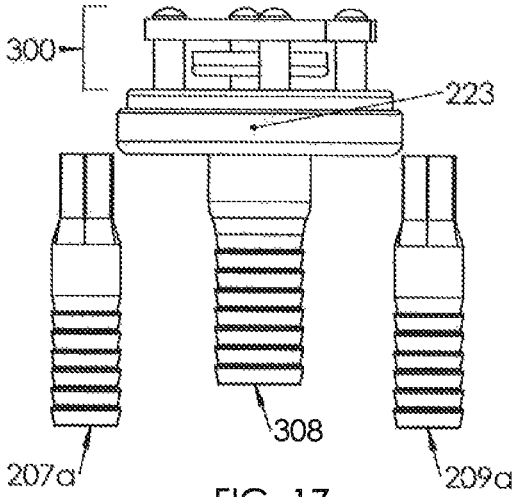
FIG. 17 is a side view of the foot valve according to the present invention.
Figure 19:
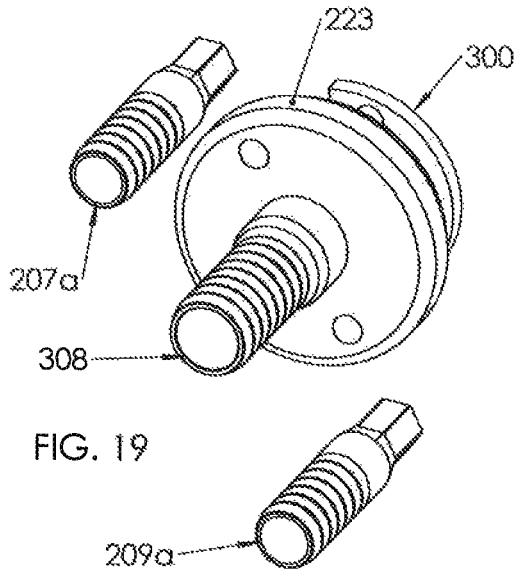
FIG. 19 is a bottom side view of the foot valve according to the present intention.

FIGS. 17-19 illustrate foot valve (300). Fluid enters into fluid pump (200) through foot valve (300). Foot valve (300) opens when compressed air is not present within fluid pump (200) and fluid pump assembly (10) is immersed in a fluid. Rising float (218) has two effects on fluid pump assembly (10) during operation with a well. Moveable donut magnet (240) approaches stationary donut magnet (238). Upper linkage plate (230) pushes closer to linkage top plate (212) through the action of linkage unit guide plate (228). When stationary donut magnet (238) comes into contact with the approaching moveably donut magnet (240), linkage top plate (212) begins to rotate, being pushed by upper linkage plate (230), which is attached to the then rising float (218). The final strong attracting magnetic pulse will snap close grommet seal (226) against its seat and an air valve internally disposed within top end cap disk (222). This action causes compressed air or gas to enter housing (100) through first air-in port (204), while air-out port (206) isolates the cylinder outside due to grommet seal (226) in its seating position.

At this point, the action starts the fluid pump (200) cycle. The presence of compressed air, or other gas, and fluid will cause a two-phase fluid flow upward out of fluid-out port (202). Compressed air or gas pressure also closes foot valve (300), an O-ring seal type, ceasing further fluid admission. The contained amount of fluid will eventually exhaust itself, and float (218) then drops. Moveable donut magnet (252) then approaches stationary donut magnet (238), and the strong magnetic attraction between moveable donut magnet (252) and stationary donut magnet (238) pulls open linkage unit guide plate (228). The check valve design of air valve (254) stops the compressed air or gas input flow, while grommet seal (226) opens the cylinder to the outside to exhaust the contained air or gas. This final action ends the cycle.

According to the present invention, fluid pump assembly (10) can be used in two modes, When it is the lowest unit immersed in the fluid, it is a source pump. The plumbing at the bottom unit is different from all the upper pump units. The upper units operate in the transfer pump mode. The present design calls for multi-unit use if well depth is greater than 300 feet, air pressure at 175 psig. Each port at the bottom end cap connects through flexible hoses with the upper end cap port of the nearest lower unit only. The port connection for compressed air or gas at the top end cap is second air-in port (208). This air or gas is routed to the bottom end cap through air-in line (209). There is no need for an extra external hose to supply the compressed air or gas. The source pump is supplied at fluid-in port (308) with a short length external wire mesh tube to minimize fouling from non-fluid solid component.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

I claim:

1. A compressed air operated fluid pump for use in conjunction with oil wells comprising:

A stainless steel housing having a top and bottom with pumping elements internally disposed within said housing, said pumping elements comprising:

(1) A float having a top and a bottom for controlling air entering and exiting said pump;

(2) A plurality of magnets operatively mounted for positioning said float as air enters and exits said pump;

(3) A plurality of air ports to facilitate air flow entering and exiting said pump;

(4) A plurality of air lines to facilitate the air flow within said pump;

(5) At least one fluid channel to facilitate moving fluid out of said pump; and

A foot valve attached at the bottom of said housing to control fluid entry into said pump and fluid exit from said pump, wherein said foot valve further comprises a bottom cap to facilitate retaining in place said plurality of air lines in relation to said pump.

2. The pump of claim 1 wherein said fluid channel is vertically positioned in relation to said float, is parallel to said float, and extends above said float for pushing fluid out of said pump.

3. The pump of claim 1 wherein said plurality of air lines are vertically positioned in relation to said float, are parallel to said float, and extend above said float to connect to said plurality of air ports, which facilitate the flow of air and exhaust within said pump.

4. The pump of claim 1 wherein said plurality of air ports comprise a first air-in port, a second air-in port, and an air-out port to facilitate air exhaust from said pump.

5. The pump of claim 1 wherein said pump further comprises a linkage unit internally disposed within said pump and positioned above said float to control the air flow into said pump and the air flow out of said pump, and wherein said linkage unit further comprises an exhaust channel seal attached to a top plate of said linkage unit to control exhaust flow within said pump, and wherein said linkage unit is connected to an adjacent linkage unit guide plate and has a linkage unit hinge pin that facilitates moving said linkage unit up and down during operation of said pump.

6. The pump of claim 1 wherein said foot valve comprises a one-way check valve that allows fluid to flow into said pump and prevents fluid from flowing out of said pump.

7. The pump of claim 1 wherein said foot valve further comprises a rubber O-ring seal to facilitate forming a seal at the bottom of said pump to facilitate retaining fluid within said pump and preventing fluid from exiting said pump.

8. The pump of claim 1 wherein said plurality of magnets comprise a stationary donut shaped magnet to facilitate moving said float upward and downward.

9. The pump of claim 1 wherein said plurality of magnets comprise a moveable donut shaped magnet connected to the bottom of said float, to facilitate reducing attraction of heavy metal deposits from crude oil, and to facilitate cleaning said plurality of magnets of heavy metals contained in crude oil by fluid pressure being forced downward inside said pump and over said plurality of magnets, by wiping clean said plurality of magnets of crude oil deposits during operation of said pump.

10. The pump of claim 1 wherein said plurality of magnets comprise a moveable donut shaped magnet positioned above said foot valve.

11. A compressed air operated fluid pump for use in conjunction with oil wells comprising:

A stainless steel housing; having pumping elements internally disposed within said housing, said pumping elements comprising:

(1) A float having a top and a bottom for controlling air entering and exiting said pump;

(2) A plurality of magnets operatively mounted for positioning said float as air enters and exits said pump;

(3) A plurality of air ports to facilitate air flow entering and exiting said pump, wherein said plurality of air ports comprise a first air-in port, a second air-in port, and an air-out port to facilitate air exhaust from said pump;

(4) A plurality of air lines to facilitate the air flow within said pump, wherein said plurality of air lines are vertically positioned in relation to said float, are parallel to said float, and extend above said float to connect to said plurality of air ports, which facilitate the flow of air and exhaust within said pump;

(5) At least one fluid channel to facilitate moving fluid out of said pump, wherein said fluid channel is vertically positioned in relation to said float, is parallel to said float, and extends above said float to facilitate pushing fluid out of said pump; and A foot valve attached to said pump to control fluid entry into said pump and fluid exit from said pump, wherein said foot valve is positioned at the bottom of said housing and comprises a one-way check valve that allows fluid to flow into said pump and prevents fluid from flowing out of said pump, and wherein said foot valve further comprises a bottom cap positioned at the bottom of said pump to facilitate retaining in place said plurality of air lines in relation to said pump;

and wherein said pump further comprises a linkage unit internally disposed within said pump and positioned above said float to control the air flow into said pump and the air flow out of said pump, and wherein said linkage unit further comprises an exhaust channel seal attached to a top plate of said linkage unit to control exhaust flow within said pump, and wherein said linkage unit is connected to an adjacent linkage unit guide plate and has a linkage unit hinge pin that facilitates moving said linkage unit up and down during operation of said pump.

* * * * *